US008622689B2

(12) United States Patent
Akamatsu et al.

(10) Patent No.: US 8,622,689 B2
(45) Date of Patent: Jan. 7, 2014

(54) ROTOR DRIVE MECHANISM AND PUMP APPARATUS

(75) Inventors: Teruaki Akamatsu, Kyoto (JP); Mikio Yamashita, Kobe (JP); Nobuhisa Suhara, Ika-gun (JP)

(73) Assignee: Heishin Sobi Kabushiki Kaisha, Kobe-shi (JP)

( * ) Notice: Subject to any disclaimer, the term of this patent is extended or adjusted under 35 U.S.C. 154(b) by 947 days.

(21) Appl. No.: 12/674,149

(22) PCT Filed: Aug. 8, 2008

(86) PCT No.: PCT/JP2008/002175

§ 371 (c)(1),
(2), (4) Date: Apr. 5, 2010

(87) PCT Pub. No.: WO2009/025074

PCT Pub. Date: Feb. 26, 2009

(65) Prior Publication Data

US 2011/0033279 A1 Feb. 10, 2011

(30) Foreign Application Priority Data

Aug. 20, 2007 (JP) ..... 2007-213552

(51) Int. Cl.
*F04C 2/107* (2006.01)

(52) U.S. Cl.
USPC ..... 415/72; 415/69; 418/48

(58) Field of Classification Search
USPC ..... 415/61, 69, 72, 75; 310/112, 114; 417/410.3, 410.4, 410.5; 418/48
See application file for complete search history.

(56) References Cited

U.S. PATENT DOCUMENTS 3,216,768 A * 11/1965 Soeding et al. ..... 417/203
4,591,322 A * 5/1986 Ono et al. ..... 418/48
5,553,742 A * 9/1996 Maruyama et al. ..... 222/1
7,473,082 B2 * 1/2009 Marielle ..... 418/48
2007/0104595 A1 * 5/2007 Jaberg et al. ..... 417/410.3

FOREIGN PATENT DOCUMENTS

| | | | |
|---|---|---|---|
| DE | 2057860 | * | 6/1972 |
| DE | 3621967 | * | 1/1988 |
| JP | 56-34082 | | 4/1981 |
| JP | 60-162088 | | 8/1985 |
| JP | 60-182378 | | 9/1985 |
| JP | 07-308619 | | 11/1995 |

OTHER PUBLICATIONS

Rieger, Eccentric worm pump with precessing rotor shaft, Jun. 8, 1972, Abstract of DE2057860.*
Lettmann, Tubular motorised pump with hollow rotor blades of turbo or eccentric worm, Jan. 14, 1988, Abstract of DE 3621967.*
ISA Japan, International Search Report of PCT/JP2008/002175, Oct. 14, 2008, WIPO, 2 pages.

* cited by examiner

*Primary Examiner* — Edward Look
*Assistant Examiner* — Liam McDowell
(74) *Attorney, Agent, or Firm* — Alleman Hall McCoy Russell & Tuttle LLP

(57) ABSTRACT

A rotor drive mechanism and pump apparatus according to the present invention may cause an external screw type rotor of a uniaxial eccentric screw pump to rotate and carry out a revolution movement. The rotor drive mechanism further comprises a shaft sealing structure configured such that a gap between an outer peripheral portion of an end portion of the revolution shaft is located on the external screw type rotor side and an inner peripheral portion of the casing in the pump apparatus is sealed. The rotor drive mechanism provides for a reduced amount of heat and vibrations to be generated when the rotor is rotated at high speed and further allows for lowering of contact pressure between an outer surface of the rotor and an inner surface of a stator inner hole.

7 Claims, 7 Drawing Sheets

ROTOR DRIVE MECHANISM AND PUMP APPARATUS

TECHNICAL FIELD

The present invention relates to a rotor drive mechanism applicable to a uniaxial eccentric screw pump capable of transferring various fluids, such as gases, liquids, and powder, and fluids containing fine particles, and also relates to a pump apparatus including the rotor drive mechanism.

BACKGROUND ART

One example of conventional pump apparatuses will be explained in reference to FIG. 7 (see Patent Document 1 for example). As shown in FIG. 7, a pump apparatus 1 includes a uniaxial eccentric screw pump 2 and a rotor drive mechanism 4 configured to rotate a rotor 3 provided in the uniaxial eccentric screw pump 2. The uniaxial eccentric screw pump 2 is configured such that the external screw type rotor 3 is inserted in an internal screw hole 5*a* of a stator 5. By rotating the rotor 3 in a predetermined direction, a fluid, such as a liquid, can be suctioned from a suction port 6 for example, held in a space between the rotor 3 and the stator 5, transferred, and then discharged from a discharge port 7. At this time, the rotor 3 carries out an eccentric rotational movement, i.e., rotates while carrying out a revolution movement about a central axis 8 of the stator inner hole 5*a* shown in FIG. 7. The rotor drive mechanism 4 causes the rotor 3 to carry out the eccentric rotational movement.

The rotor drive mechanism 4 shown in FIG. 7 includes an input shaft 9 which is rotated by a rotation driving portion (for example, an electric motor, not shown). The input shaft 9 is coupled to an output shaft 11 via a gear 10 and the like gears. The output shaft 11 is coupled to an end portion of the rotor 3.

To be specific, when the rotation driving portion rotates, the rotation of the rotation driving portion is transferred via the input shaft 9, the gear 10 and the like gears, and the output shaft 11 to the rotor 3, and the rotor 3 then carries out the eccentric rotational movement. With this, the fluid can be suctioned from the suction port 6 and discharged from the discharge port 7.

Next, the rotor drive mechanism 4 will be explained in detail in reference to FIG. 7. The input shaft 9 is rotatably provided on a casing 12 via bearings, and the first outer gear 10 is attached to the input shaft 9. The first outer gear 10 engages with a second outer gear 13, and the second outer gear 13 is attached to a crank drum 14. The crank drum 14 is rotatably provided on the casing 12 via bearings. A crank shaft 15 is eccentrically and rotatably provided inside the crank drum 14 via bearings. The output shaft 11 is coupled to a left end portion of the crank shaft 15 in FIG. 7. A third outer gear 16 is provided at a right end portion of the crank shaft 15 in FIG. 7 and engages with an inner gear 17. The inner gear 17 is fixedly provided on the casing 12.

In accordance with the rotor drive mechanism 4, since the output shaft 11 and the crank shaft 15 are provided on the same axis 18, and the central axis 18 of the crank shaft 15 is eccentrically provided with respect to the central axis 8 of the crank drum 14, the rotation of the crank drum 14 can cause the rotor 3 to carry out a revolution movement about the central axis 8 of the stator inner hole 5*a*.

Moreover, since the third outer gear 16 provided at one end portion of the rotor 3 engages with the inner gear 17, the rotor 3 carrying out the revolution movement can be caused to rotate. With this configuration, the fluid can be discharged from the discharge port 7 by rotating the rotor 3 attached to the stator inner hole 5*a*.

Patent Document 1: Japanese Laid-Open Patent Application Publication No. 60-162088

DISCLOSURE OF THE INVENTION

Problems to be Solved by the Invention

The rotor drive mechanism 4 included in the conventional pump apparatus 1 shown in FIG. 7 is configured such that the rotation of the input shaft 9 is transferred to the output shaft 11 via the first outer gear 10, the second outer gear 13, the third outer gear 16, and the inner gear 17 to cause the rotor 3 to rotate and carry out the revolution movement. As above, the rotor drive mechanism 4 includes a large number of gears. Therefore, in a case where the rotor 3 is rotated at high speed, the rotor drive mechanism 4 generates heat to increase in temperature and generates comparatively high vibrations by, for example, frictions between gears.

In accordance with the conventional pump apparatus 1, power for the revolution movement and rotation movement of the rotor 3 is obtained from the single input shaft 9. Therefore, it is difficult to adjust a positional relation between a revolution position of the rotor 3 and a rotation position of the rotor 3. On this account, a contact pressure between an outer surface of the rotor 3 and an inner surface of a stator inner hole 5*a* when the rotor 3 rotates cannot be adjusted to be lower than a current contact pressure, for example. Purposes of lowering the contact pressure between the outer surface of the rotor 3 and the inner surface of the stator inner hole 5*a* are to reduce the power for causing the rotor to rotate and carry out the revolution movement and to reduce abrasions caused by the contact between the outer surface of the rotor 3 and the inner surface of the stator inner hole 5*a*. A further purpose is to use the rotor 3 rotating at high speed by reducing the power and the abrasions.

The present invention was made to solve the above problems, and an object of the present invention is to provide a rotor drive mechanism and a pump apparatus, each of which realizes that the rotor rotating at high speed can be used by reducing the amount of heat and vibrations generated when the rotor is rotated at high speed and by lowering the contact pressure between the outer surface of the rotor and the inner surface of the stator inner hole or preventing the outer surface of the rotor and the inner surface of the stator inner hole from contacting each other.

Means for Solving the Problems

A rotor drive mechanism according to the present invention is capable of causing an external screw type rotor of a uniaxial eccentric screw pump to rotate and carry out a revolution movement, the uniaxial eccentric screw pump being configured such that the external screw type rotor is attached to an inner hole of an internal screw type stator, wherein the external screw type rotor is able to be driven by a rotation speed control driving portion to rotate and is driven by a revolution speed control driving portion to carry out the revolution movement.

In accordance with the rotor drive mechanism of the present invention, the external screw type rotor can be rotated at an appropriate speed and phase by the control of the rotation speed control driving portion and can carry out the revolution movement at an appropriate speed and phase by the control of the revolution speed control driving portion. Thus, the rotor can be caused to rotate and carry out the revolution movement about the stator inner hole at a desired speed and phase (the rotor can be caused to carry out the eccentric rotational movement). For example, a rotation direction of the rotor and a revolution direction of the rotor can be set to be opposite to each other. A space formed by the outer surface of the rotor and the inner surface of the stator inner hole moves from one opening of the stator inner hole to the other opening of the stator inner hole by the eccentric rotational movement of the rotor. Therefore, the fluid can be transferred in this direction.

Moreover, the positional relation between the rotation position of the rotor and the revolution position of the rotor is adjusted by the rotation speed control driving portion and the revolution speed control driving portion (respective phases of the rotation position of the rotor and the revolution position of the rotor are adjusted by the rotation speed control driving portion and the revolution speed control driving portion). In addition, the rotation speed control driving portion and the revolution speed control driving portion are driven at a desired rotating speed. With this, the rotor can be caused to carry out the eccentric rotational movement along a desired path. Thus, the rotor and the stator inner hole can be formed such that the outer surface of the rotor and the inner surface forming the stator inner hole do not contact each other or contact each other at appropriate contact pressure.

In the rotor drive mechanism according to the present invention claim 1, the rotor drive mechanism includes: a rotation shaft configured to have a central axis at a certain position that is rotatably supported; and a revolution shaft configured to: be supported so as to be able to revolve about a certain central position and rotate; and have one end portion coupled to the rotation shaft via a power transmission portion and the other end portion coupled to the external screw type rotor, wherein the rotation shaft is rotated by the rotation speed control driving portion, and the revolution shaft is revolved by the revolution speed control driving portion to carry out an eccentric rotational movement.

In accordance with the rotor drive mechanism herein, when the rotation speed control driving portion is driven, the power of the rotation speed control driving portion can be transferred to the revolution shaft via the rotation shaft and the power transmission portion to rotate the revolution shaft. Then, when the revolution speed control driving portion is driven, the revolution shaft can be caused to carry out the revolution movement. With this, the revolution shaft can be caused to carry out the eccentric rotational movement, and therefore, the rotor coupled to the revolution shaft can be caused to carry out the eccentric rotational movement.

In the rotor drive mechanism according to the present invention claim 2, the rotor drive mechanism further includes an eccentric supporting portion rotatably provided on a casing to be rotated by the revolution speed control driving portion, wherein the revolution shaft is rotatably provided in the eccentric supporting portion so as to be eccentrically located with respect to a central axis of the eccentric supporting portion.

In accordance with the rotor drive mechanism herein, the eccentric supporting portion can support the revolution shaft such that the revolution shaft is rotatable, and the revolution shaft can be caused to carry out the revolution movement by the rotation of the eccentric supporting portion. Thus, the eccentric supporting portion can support the revolution shaft such that the revolution shaft can carry out the eccentric rotational movement.

In the rotor drive mechanism described herein, the rotor drive mechanism is configured such that the power transmission portion is a flexible joint or an Oldham coupling.

In accordance with the rotor drive mechanism according to the present invention, a rotation center of the rotation shaft and a rotation center of the revolution shaft do not coincide with each other, but a rotational power of the rotation shaft can be transferred to the revolution shaft via the power transmission portion. By using the flexible joint as the power transmission portion, the power transmission portion can be simplified in configuration and reduced in weight. By using the Oldham coupling as the power transmission portion, a synchronization error between the rotation of the rotation shaft and the rotation of the revolution shaft can be reduced. With this, the rotation position of the rotor and the revolution position of the rotor during the eccentric rotational movement can be caused to accurately coincide with a predetermined positional relation. As a result, the rotor can be caused to accurately carry out the eccentric rotational movement such that the outer surface of the rotor and the inner surface forming the stator inner hole do not contact each other with a predetermined gap therebetween or contact each other at appropriate contact pressure.

In one embodiment, the rotor drive mechanism is configured such that each of the rotation speed control driving portion and the revolution speed control driving portion is an electric servo motor.

By using an electric servo motor as each of the rotation speed control driving portion and the revolution speed control driving portion, the speed and phase of the rotation of the rotor and the speed and phase of the revolution of the rotor can be easily and accurately controlled. Thus, the outer surface of the rotor and the inner surface forming the stator inner hole can be accurately adjusted or changed such that the outer surface of the rotor and the inner surface forming the stator inner hole do not contact each other or contact each other at appropriate contact pressure.

The rotor drive mechanism further includes a pump apparatus and a uniaxial eccentric screw pump configured to be rotated by the rotor drive mechanism.

Therefore, the external screw type rotor can be rotated at an appropriate speed and phase by the control of the rotation speed control driving portion and can carry out the revolution movement at an appropriate speed and phase by the control of the revolution speed control driving portion. By causing the rotor to carry out a desired eccentric rotational movement, the space formed by the outer surface of the rotor and the inner surface of the stator inner hole can be moved from one opening of the stator inner hole to the other opening of the stator inner hole. Thus, the fluid can be transferred in this direction.

The pump apparatus may be configured such that the rotor drive mechanism rotates the external screw type rotor with the external screw type rotor not contacting an inner surface of the inner hole of the internal screw type stator.

The rotor can be caused to carry out the eccentric rotational movement with the rotor not contacting the inner surface of the stator inner hole. Therefore, for example, in a case where a fluid containing fine particles is transferred, the gap between the rotor and the stator inner surface can be set such that the fine particles are not grated by the rotor and the stator inner surface, and the fine particles can be transferred while maintaining the original shapes of the fine particles. Moreover, abrasion powder generated in a case where the rotor and the stator inner surface contact each other does not get mixed in the transfer fluid, and a noise is not generated by the friction between the rotor and the stator inner surface. Moreover, the gap between the outer peripheral surface of the rotor and the inner peripheral surface of the stator inner hole can be set to an appropriate size depending on the property of the transfer fluid (for example, a fluid containing fine particles or slurry). With this, depending on various properties of fluids, the pump apparatus can transfer and fill the fluid with high flow rate accuracy and a long operating life. Further, since the rotor can be caused to carry out the eccentric rotational movement with the rotor not contacting the inner surface of the stator inner hole, the rotor can be caused to carry out the eccentric rotational movement at a comparatively high speed, so that a comparatively high transfer ability can be obtained.

The pump apparatus further includes a shaft sealing structure configured such that a gap between an outer peripheral portion of an end portion of the revolution shaft which end portion is located on the external screw type rotor side and an inner peripheral portion of the casing in the pump apparatus is sealed by at least a diaphragm.

In accordance with the pump apparatus according to the present invention, when the revolution shaft is driven by the revolution speed control driving portion to carry out the revolution movement, the diaphragm of the shaft sealing structure freely deforms with respect to the revolution movement of the revolution shaft. Therefore, a gap between the outer peripheral portion of the end portion of the revolution shaft which end portion is located on the external screw type rotor side and the inner peripheral portion of the casing in the pump apparatus can be surely sealed by an extremely simple configuration. Therefore, in accordance with the shaft sealing structure, the fluid in the pump apparatus can be sealed in a comparatively small space. With this, cleaning of the pump apparatus can be simplified, and the amount of fluid remaining in the pump apparatus can be reduced.

Furthermore the pump apparatus is configured such that: the shaft sealing structure includes a circular coupling portion having an insert hole through which the revolution shaft is rotatably inserted; a gap between an inner peripheral portion of the circular coupling portion and an outer peripheral portion of the revolution shaft is sealed by a sealing portion; and a gap between an outer peripheral portion of the circular coupling portion and the inner peripheral portion of the casing is sealed by the diaphragm.

In accordance with the pump apparatus according to the present invention, an annular gap between the outer peripheral portion of the rotating revolution shaft and the inner peripheral portion of the circular coupling portion can be sealed by the sealing portion of the shaft sealing structure.

EFFECTS OF THE INVENTION

In accordance with the rotor drive mechanism and the pump apparatus described, the external screw type rotor can be caused to rotate and carry out the revolution movement at an appropriate speed and phase by the control of the rotation speed control driving portion and the revolution speed control driving portion, i.e., the external screw type rotor can be caused to carry out the eccentric rotational movement. Therefore, it is possible to omit gears used to cause the rotor to carry out the eccentric rotational movement or to reduce the number of gears. With this, even in a case where the rotor is caused to carry out the eccentric rotational movement at high speed, it is possible to prevent the rotor drive mechanism from generating heat and increasing in temperature and to prevent the rotor drive mechanism from generating comparatively high vibrations.

Since the rotation movement of the rotor and the revolution movement of the rotor are respectively carried out by the rotation speed control driving portion and the revolution speed control driving portion, the positional relation between the rotation position of the rotor and the revolution position of the rotor can be freely adjusted. Therefore, the rotor can be caused to carry out the eccentric rotational movement along a desired certain path such that, for example, the outer surface of the rotor and the inner surface of the stator inner hole do not contact each other. A gap between the rotor and the stator inner surface is formed such that, for example, when transferring the transfer fluid containing fine particles, the fine particles are not grated by the rotor and the stator inner surface. With this, the transfer fluid can be transferred while maintaining the original shapes of the fine particle, i.e., maintaining the quality of the fine particles.

The rotor can be caused to carry out the eccentric rotational movement such that the outer surface of the rotor and the inner surface of the stator inner hole do not contact each other or contact each other at appropriate contact pressure. Therefore, it is possible to prevent or suppress the abrasion of the rotor and the stator and also possible to reduce the power used to rotate the rotor.

EXPLANATION OF REFERENCE NUMBERS

Figure 1:
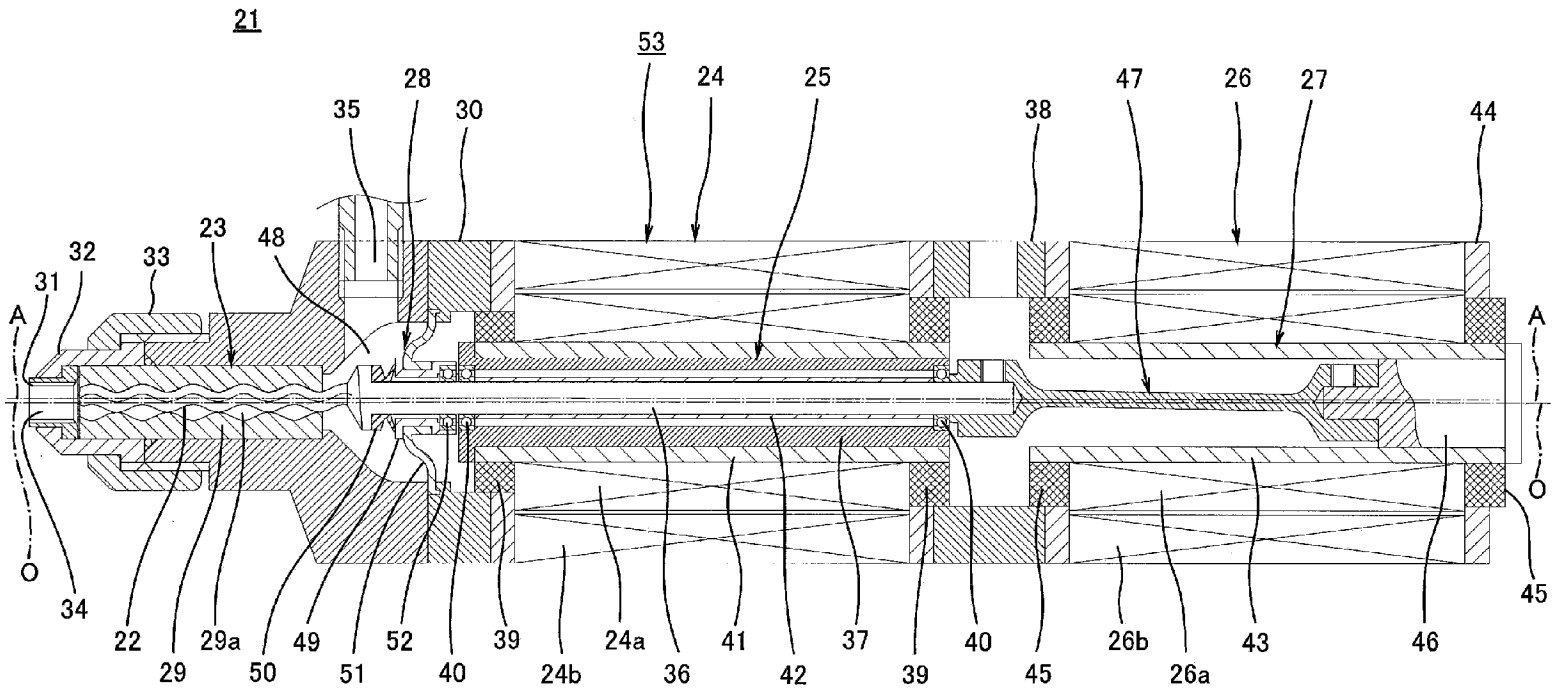
FIG. 1 is a longitudinal sectional view showing Embodiment 1 of a pump apparatus according to the present invention.

21, 54, 61, 70 pump apparatus
22 rotor
23 uniaxial eccentric screw pump
24, 62 revolution speed control driving portion
24*a* rotor portion
24*b* stator portion
25, 63 rotor revolution drive mechanism
26, 55 rotation speed control driving portion
26*a* rotor portion
26*a* stator portion
27, 56 rotor rotation drive mechanism
28 revolution shaft sealing structure
29 stator
29*a* stator inner hole
30 pump casing
31 nozzle
32 socket
33 nut
34 first opening
35 second opening
36 revolution shaft

37 eccentric supporting portion
38 intermediate casing
39, 40, 45, 52, 68 bearing
41 first outer sleeve
42 inner sleeve
43 second outer sleeve
44 end casing
46 rotation shaft
47, 57 power transmission portion
48 accommodating space
49 circular coupling portion
49*a* through hole
50 sealing portion
51 diaphragm
53 rotor drive mechanism
57*a* driving portion of power transmission portion
57*b* intermediate portion of power transmission portion
57*c* driven portion of power transmission portion
58 reducer
59 coupling member
64 rotating shaft
65 first timing pulley
66 second timing pulley
67 timing belt

BEST MODE FOR CARRYING OUT THE INVENTION

Hereinafter, a rotor drive mechanism according to Embodiment 1 of the present invention and a pump apparatus including the rotor drive mechanism will be explained in reference to FIGS. 1 and 2. A pump apparatus 21 shown in FIG. 1 can cause an external screw type rotor 22 to rotate and carry out a revolution movement along a predetermined path (to carry out an eccentric rotational movement). With this, the pump apparatus 21 can transfer and fill any fluids, such as low-viscosity fluids and high-viscosity fluids, with high flow rate accuracy and a long operating life. The pump apparatus 21 can transfer various fluids, such as gases, liquids, and powder, and fluids containing fine particles.

As shown in FIG. 1, the pump apparatus 21 includes a uniaxial eccentric screw pump 23, a revolution speed control driving portion 24, a rotor revolution drive mechanism 25, a rotation speed control driving portion 26, a rotor rotation drive mechanism 27, and a revolution shaft sealing structure 28.

Figure 2:
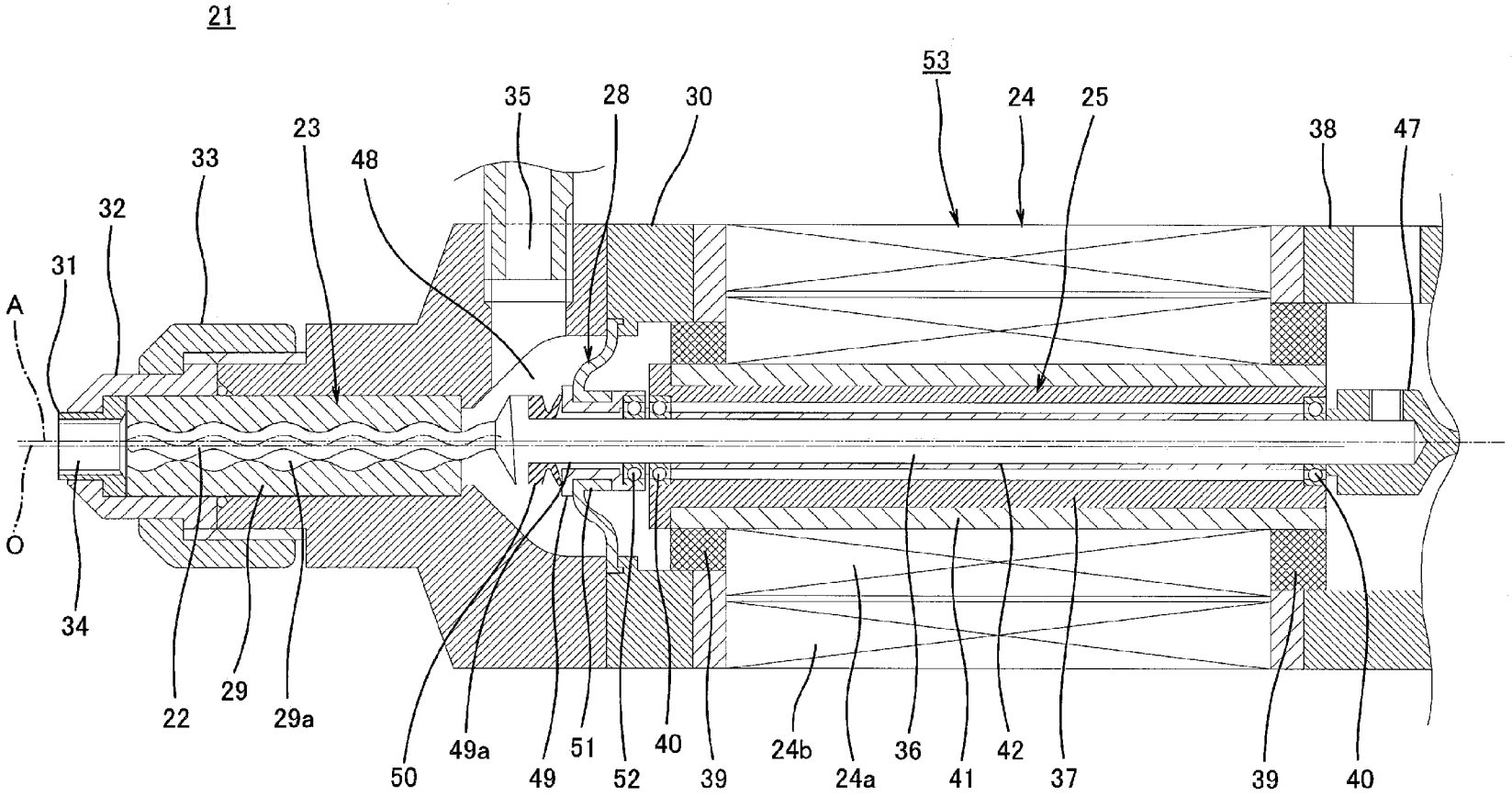
FIG. 2 is an enlarged longitudinal sectional view showing a rotor revolution drive mechanism of the pump apparatus according to Embodiment 1.

As shown in FIG. 2, the uniaxial eccentric screw pump 23 is a rotary volume type pump and includes an internal screw type stator 29 and the external screw type rotor 22.

As shown in FIG. 2, the stator 29 is formed to have a substantially short cylindrical shape having an inner hole 29*a* of a double thread internal screw shape, for example. A longitudinal cross-sectional shape of the inner hole 29*a* is elliptical. The stator 29 is formed by engineering plastic, such as Teflon (trademark), polyacetal, or cast nylon. A rear end portion of the stator 29 is attached in a pump casing 30, and a nozzle 31 is attached to a tip end portion of the stator 29. In this state, the stator 29 is attached to the pump casing 30 by a nut 33 via a socket 32.

As shown in FIG. 2, the nozzle 31 has a first opening 34, and the pump casing 30 has a second opening 35. The first opening 34 can be used as a discharge port or a suction port, and the second opening 35 can be used as a suction port or a discharge port. The first opening 34 is communicated with a tip end opening of the inner hole 29*a* of the stator 29, and the second opening 35 is communicated with a rear end opening of the inner hole 29*a*.

As shown in FIG. 2, the rotor 22 is formed to have a single thread external screw shape for example. A longitudinal cross-sectional shape of the rotor 22 is a substantially perfect circle. A pitch of a spiral shape of the rotor 22 is set to half a pitch of the stator inner hole 29*a*. The rotor 22 is formed by a metal, such as stainless steel, and is fittingly inserted in the inner hole 29*a* of the stator 29. A rear end portion of the rotor 22 is coupled to a revolution shaft 36 of the rotor revolution drive mechanism 25.

As shown in FIG. 2, the rotor revolution drive mechanism 25 includes an eccentric supporting portion 37. The eccentric supporting portion 37 is formed to have a short cylindrical shape. The eccentric supporting portion 37 is rotatably provided on the pump casing 30 and an intermediate casing 38 via bearings 39 and is rotated by the revolution speed control driving portion 24. A central axis O of the rotation of the eccentric supporting portion 37 coincides with the central axis O of the stator inner hole 29*a*. The revolution shaft 36 is provided in the eccentric supporting portion 37.

As shown in FIG. 2, the revolution shaft 36 is rotatably provided on the eccentric supporting portion 37 via bearings 40 so as to be eccentrically located with respect to the central axis O of the eccentric supporting portion 37. A central axis of the rotation of the revolution shaft 36 is shown by A, and the central axes O and A are eccentrically provided with respect to each other by e. In FIG. 2, reference number 41 denotes a first outer sleeve, and reference number 42 denotes an inner sleeve.

The revolution speed control driving portion 24 uses the eccentric supporting portion 37 and the revolution shaft 36 shown in FIG. 2 to cause the rotor 22 to carry out the revolution movement. The revolution speed control driving portion 24 is an electric speed control motor, such as a hollow servo motor or a hollow stepping motor. As shown in FIG. 2, the revolution speed control driving portion 24 includes a rotor portion 24*a* and a stator portion 24*b*. The rotor portion 24*a* is fixedly provided on an outer peripheral portion of the first outer sleeve 41, and the stator portion 24*b* is provided between the pump casing 30 and the intermediate casing 38. When the revolution speed control driving portion 24 rotates the eccentric supporting portion 37 in a normal direction or a reverse direction, this rotation of the eccentric supporting portion 37 is transferred to the rotor 22 via the revolution shaft 36. Thus, the rotor 22 carries out the revolution movement about the central axis O of the stator inner hole 29*a* at a predetermined angular speed and phase.

As shown in FIG. 1, the rotor rotation drive mechanism 27 includes a second outer sleeve 43. The second outer sleeve 43 is formed to have a short cylindrical shape. The second outer sleeve 43 is rotatably provided on the intermediate casing 38 and an end casing 44 via bearings 45. The second outer sleeve 43 is rotated by the rotation speed control driving portion 26. The central axis O of the rotation of the second outer sleeve 43 coincides with each of the central axis O of the stator inner hole 29*a* and the central axis O of the rotation of the first outer sleeve 41 (eccentric supporting portion 37). A rotation shaft 46 is fixedly attached in the second outer sleeve 43.

As shown in FIG. 1, the rotation shaft 46 is provided in the second outer sleeve 43 so as to be coaxial with the central axis O. A tip end portion of the rotation shaft 46 and a rear end portion of the revolution shaft 36 are coupled to each other via a power transmission portion 47, such as a flexible joint. The flexible joint is formed by a flexible rod-like body made of synthetic resin, for example.

The rotation speed control driving portion 26 rotates the rotor 22 via the second outer sleeve 43, the rotation shaft 46, the power transmission portion 47, and the revolution shaft 36 shown in FIG. 1. The rotation speed control driving portion 26 is an electric speed control motor, such as a hollow servo motor or a hollow stepping motor. As shown in FIG. 1, the rotation speed control driving portion 26 includes a rotor portion 26*a* and a stator portion 26*b*. The rotor portion 26*a* is fixedly provided on an outer peripheral portion of the second outer sleeve 43, and the stator portion 26*b* is provided between the intermediate casing 38 and the end casing 44. When the rotation speed control driving portion 26 rotates the second outer sleeve 43 in the normal direction or the reverse direction, this rotation of the second outer sleeve 43 is transferred to the rotor 22 via the rotation shaft 46, the power transmission portion 47, and the revolution shaft 36. Thus, the rotor 22 rotates about the central axis A at a predetermined rotating speed and phase.

As shown in FIG. 2, the revolution shaft sealing structure 28 seals between an outer peripheral surface of the revolution shaft 36 configured to carry out the eccentric rotational movement and an inner peripheral surface of the pump casing 30 forming an accommodating space 48 in which the revolution shaft 36 is stored so as to be able to carry out the eccentric rotational movement. The revolution shaft sealing structure 28 is provided at an end portion of the revolution shaft 36 which portion is located on the external screw type rotor 22 side.

The revolution shaft sealing structure 28 includes a circular coupling portion 49 having a through hole 49*a* through which the end portion of the revolution shaft 36 is rotatably inserted. A gap between an outer peripheral surface of the end portion of the revolution shaft 36 and an inner peripheral surface of the circular coupling portion 49 is sealed by a sealing portion 50. To be specific, as shown in FIG. 2, the sealing portion 50 slidably contacts the outer peripheral surface of the end portion of the revolution shaft 36 and the end surface of the circular coupling portion 49 to seal these contact portions.

A gap between an outer peripheral surface of the circular coupling portion 49 and the inner peripheral surface of the pump casing 30 is sealed by a diaphragm 51. The circular coupling portion 49 is rotatably attached to an end portion of the revolution shaft 36 via a bearing 52.

In accordance with the revolution shaft sealing structure 28 shown in FIG. 2, when the end portion of the revolution shaft 36 carries out the eccentric rotational movement to carry out the revolution movement, the diaphragm 51 freely deforms with respect to the revolution movement of the end portion of the revolution shaft 36. Therefore, a gap between the end portion of the revolution shaft 36 and the inner peripheral surface of the pump casing 30 forming the accommodating space 48 can be surely sealed by an extremely simple configuration.

Therefore, in accordance with the revolution shaft sealing structure 28, the fluid in the pump apparatus 21 can be sealed in the comparatively small accommodating space 48. With this, cleaning of the pump apparatus 21 can be simplified, and the amount of fluid remaining in the pump apparatus 21 can be reduced.

An annular gap between the outer peripheral surface of the end portion of the rotating revolution shaft 36 and the inner peripheral surface of the circular coupling portion 49 can be sealed by the sealing portion 50. Thus, it is possible to prevent a transfer fluid, transferred by the uniaxial eccentric screw pump 23, from flowing into the rotor revolution drive mechanism 25 and the revolution speed control driving portion 24, and also possible to prevent, for example, lubricant in the rotor revolution drive mechanism 25 from flowing into the stator 29.

Next, operations when transferring the transfer fluid using the pump apparatus 21 including a rotor drive mechanism 53 shown in FIGS. 1 and 2 will be explained. By driving the rotation speed control driving portion 26 of the pump apparatus 21, the external screw type rotor 22 can be rotated while controlling the external screw type rotor 22 at an appropriate rotating speed and phase. In addition, by driving the revolution speed control driving portion 24, the external screw type rotor 22 can be caused to carry out the revolution movement while controlling the external screw type rotor 22 at an appropriate angular speed and phase. Thus, the rotor 22 can be caused to rotate at a desired rotating speed and phase while carrying out the revolution movement about the central axis O (the inner hole 29*a* of the stator 29) along a predetermined certain path at a desired angular speed and phase, i.e., the rotor 22 can be caused to carry out the eccentric rotational movement. In the eccentric rotational movement, for example, if the rotor 22 revolves once in the normal direction, it rotates once in the reverse direction.

By the eccentric rotational movement of the rotor 22, a space formed by the outer surface of the rotor 22 and the inner surface of the stator inner hole 29*a* moves in a direction from the second opening 35 side to the first opening 34 side for example. Therefore, the transfer fluid can be transferred in this direction. Thus, the transfer fluid can be suctioned from the second opening 35 and discharged from the first opening 34. By reversely rotating the rotation speed control driving portion 26 and the revolution speed control driving portion 24, the transfer fluid can be suctioned from the first opening 34 and discharged from the second opening 35.

Moreover, the positional relation between the rotation position of the rotor 22 and the revolution position of the rotor 22 is adjusted by the rotation speed control driving portion 26 and the revolution speed control driving portion 24 (respective phases of the rotation position of the rotor 22 and the revolution position of the rotor 22 are adjusted by the rotation speed control driving portion 26 and the revolution speed control driving portion 24). In addition, the rotation speed control driving portion 26 and the revolution speed control driving portion 24 are driven at a desired rotating speed. With this, the rotor 22 can be caused to carry out the eccentric rotational movement along a desired path. Thus, the rotor 22 and the inner hole 29*a* of the stator 29 can be formed such that the outer surface of the rotor 22 and the inner surface forming the inner hole 29*a* of the stator 29 do not contact each other or contact each other at appropriate contact pressure.

As a method for setting the pump apparatus 21 such that the outer surface of the rotor 22 and the inner surface of the stator inner hole 29*a* do not contact each other or contact each other at appropriate contact pressure by using the rotor 22 and the stator 29 and adjusting the positional relation between the rotation position of the rotor 22 and the revolution position of the rotor 22, i.e., that the rotor 22 is caused to carry out the eccentric rotational movement along a desired path by using the rotor 22 and the stator 29 and adjusting the positional relation between the rotation position and revolution position of the rotor 22, there is a method for: detecting load torques applied to the rotation speed control driving portion 26 and the revolution speed control driving portion 24 when these driving portions are driven; selecting the rotating speed and phase of the rotor portion 26*a* of the rotation speed control driving portion 26 and the rotating speed and phase of the rotor portion 24*a* of the revolution speed control driving portion 24 such that each of the load torques becomes the smallest or appropriate; and setting the selected rotating speeds and phases in the pump apparatus 21.

Further, the rotor drive mechanism 53 shown in FIG. 1 is configured such that the rotation speed control driving portion 26 and the revolution speed control driving portion 24 can cause the external screw type rotor 22 to carry out the eccentric rotational movement, i.e., to rotate and carry out the revolution movement at an appropriate speed and phase. Therefore, it is possible to omit gears used to cause the rotor 22 to carry out the eccentric rotational movement or to reduce the number of gears. With this, even in a case where the rotor 22 is caused to carry out the eccentric rotational movement at high speed, it is possible to prevent the rotor drive mechanism 53 from generating heat and increasing in temperature and to prevent the rotor drive mechanism 53 from generating comparatively high vibrations.

Since the rotation movement of the rotor 22 and the revolution movement of the rotor 22 are respectively carried out by the rotation speed control driving portion 26 and the revolution speed control driving portion 24, the positional relation between the rotation position of the rotor 22 and the revolution position of the rotor 22 (respective phases of the rotation position of the rotor 22 and the revolution position of the rotor 22) can be freely adjusted. Therefore, the rotor 22 can be caused to carry out the eccentric rotational movement along a desired certain path such that, for example, the outer surface of the rotor 22 and the inner surface of the stator inner hole 29*a* do not contact each other.

To be specific, for example, the rotor 22 and the stator 29 can be formed such that when transferring the fluid containing fine particles, the fine particles are not grated by the rotor 22 and the inner surface of the stator 29. With this, the transfer fluid can be transferred while maintaining the original shapes of the fine particles. Examples of the fine particles are comparatively soft powder bodies, capsule-like bodies, and sac-like bodies.

Moreover, abrasion powder generated in a case where the rotor 22 and the inner surface of the stator 29 contact each other does not get mixed in the transfer fluid, and a noise is not generated by the friction between the rotor 22 and the inner surface of the stator 29. Moreover, the gap between an outer peripheral surface of the rotor 22 and an inner peripheral surface of the stator 29 can be set to an appropriate size depending on the property of the transfer fluid (for example, a fluid containing fine particles or slurry). With this, depending on various properties of fluids, the pump apparatus 21 can transfer and fill the fluid with high flow rate accuracy, low pulsation, and a long operating life. Further, since the rotor 22 and the stator 29 can be rotated with the rotor 22 and the stator 29 not contacting each other, the rotor 22 can be rotated at a comparatively high speed by low torque, so that a comparatively high transfer ability can be obtained.

By forming the inner surface of the stator inner hole 29*a* and the outer surface of the rotor 22 such that the inner surface of the stator inner hole 29*a* and the outer surface of the rotor 22 contact each other at appropriate contact pressure and rotating the rotor 22, the efficiency of transferring the transfer fluid by the pump apparatus 21 can be improved.

Further, as shown in FIG. 1, although the central axis O of the rotation of the rotation shaft 46 and the central axis A of the rotation of the revolution shaft 36 do not coincide with each other, the rotational power of the rotation shaft 46 can be transferred to the revolution shaft 36 via the power transmission portion 47. By using a flexible joint as the power transmission portion 47, the power transmission portion 47 can be simplified in configuration and reduced in weight.

As shown in FIG. 1, by using the electric servo motor as each of the rotation speed control driving portion 26 and the revolution speed control driving portion 24, the speed and phase of the rotation movement of the rotor 22 and the speed and phase of the revolution movement of the rotor 22 can be easily and accurately controlled. With this, the outer surface of the rotor 22 and the inner surface forming the inner hole 29*a* of the stator 29 can be accurately adjusted and changed such that these surfaces do not contact each other or contact each other at appropriate contact pressure. Moreover, by using the hollow servo motor, the rotor rotation drive mechanism 27 and the rotor revolution drive mechanism 25 can be respectively stored in the rotation speed control driving portion 26 and the revolution speed control driving portion 24. Thus, the pump apparatus 21 can be simplified in configuration and reduced in size.

Figure 3:
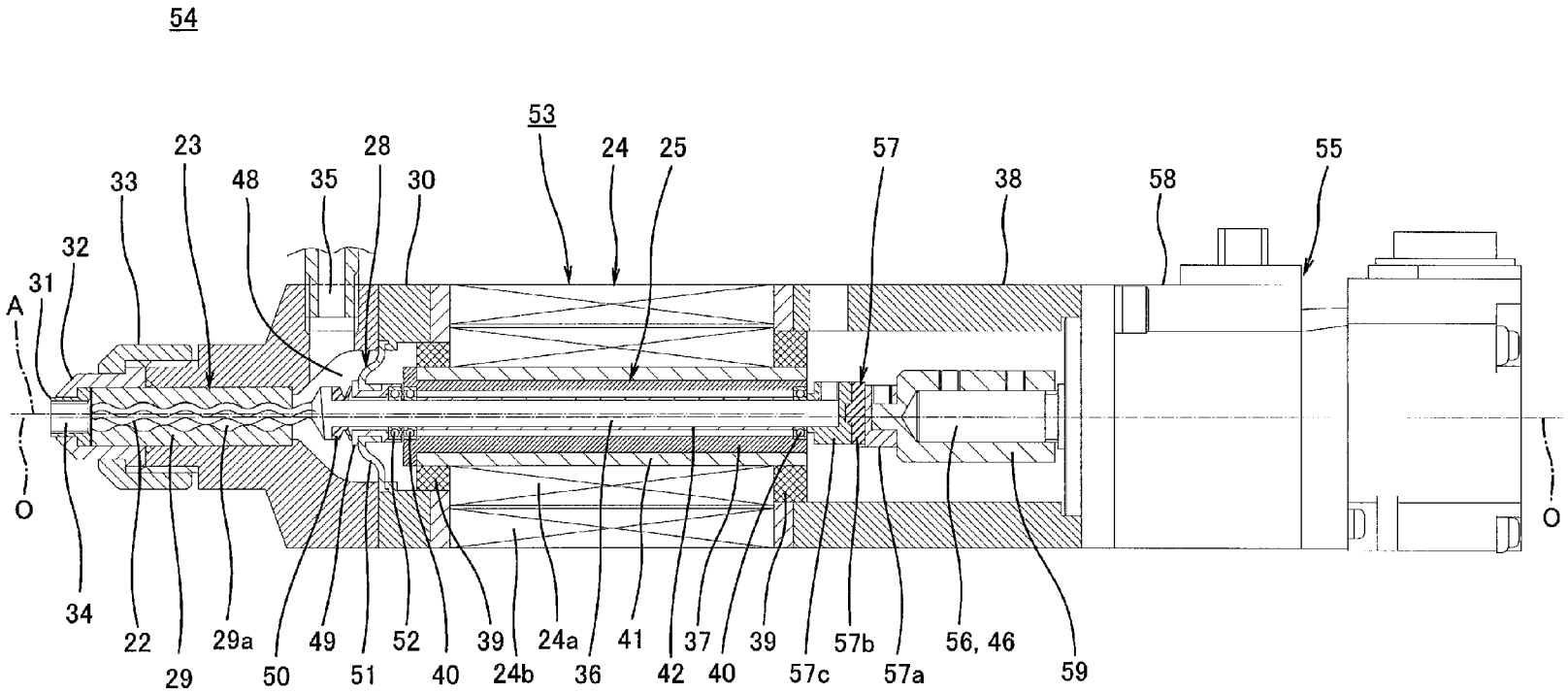
FIG. 3 is a longitudinal sectional view showing Embodiment 2 of the pump apparatus according to the present invention.

Next, the rotor drive mechanism according to Embodiment 2 of the present invention and the pump apparatus including the rotor drive mechanism will be explained in reference to FIG. 3. A rotation speed control driving portion 55, a rotor rotation drive mechanism 56, and a power transmission portion 57 in a pump apparatus 54 of Embodiment 2 shown in FIG. 3, are respectively different from the rotation speed control driving portion 26, the rotor rotation drive mechanism 27, and the power transmission portion 47 in the pump apparatus 21 of Embodiment 1 shown in FIG. 1. Other than these, the pump apparatus 54 of Embodiment 2 is the same as the pump apparatus 21 of Embodiment 1. The same reference numbers are used for the same components, and a repetition of the same explanation is avoided.

As shown in FIG. 3, the rotation speed control driving portion 55 is an electric speed control motor, such as a servo motor or a stepping motor, which is not hollow. The rotation speed control driving portion 55 is attached to an end portion of the intermediate casing 38. A rotating shaft of a reducer 58 included in the rotation speed control driving portion 55 is used as the rotation shaft 46. Therefore, the rotor rotation drive mechanism 56 is the rotation shaft 46.

As shown in FIG. 3, used as the power transmission portion 57 is a known Oldham coupling. As with Embodiment 1, the power transmission portion 57 can transfer the rotation of the rotation shaft 46 to the revolution shaft 36, eccentrically provided with respect to the rotation shaft 46, to rotate the revolution shaft 36. The power transmission portion 57 that is the Oldham coupling includes a driving portion 57*a*, an intermediate portion 57*b*, and a driven portion 57*c*. The driving portion 57*a* is coupled to the rotation shaft 46 via a coupling member 59. The coupling member 59 has a short tubular shape and is attached to and coupled to the rotation shaft 46. The driven portion 57*c* is coupled to the revolution shaft 36, and the intermediate portion 57*b* couples the driving portion 57*a* with the intermediate portion 57*b*.

As with Embodiment 1, in accordance with the pump apparatus 54 of Embodiment 2 shown in FIG. 3, by driving the rotation speed control driving portion 55 and the revolution speed control driving portion 24 in, for example, the normal direction (or the reverse direction), the transfer fluid can be suctioned from the second opening 35 (or the first opening 34) and discharged from the first opening 34 (or the second opening 35).

By using the Oldham coupling as the power transmission portion 57, a synchronization error between the rotation of the rotation shaft 46 and the rotation of the revolution shaft 36 can be reduced. With this, the rotation position of the rotor 22 and the revolution position of the rotor 22 during the eccentric rotational movement can be caused to accurately coincide with a predetermined positional relation (predetermined phase relation). As a result, the rotor 22 can be caused to accurately carry out the eccentric rotational movement such that the outer surface of the rotor 22 and the inner surface forming the inner hole 29*a* of the stator 29 do not contact each other with a predetermined gap therebetween or contact each other at appropriate contact pressure.

Figure 4:
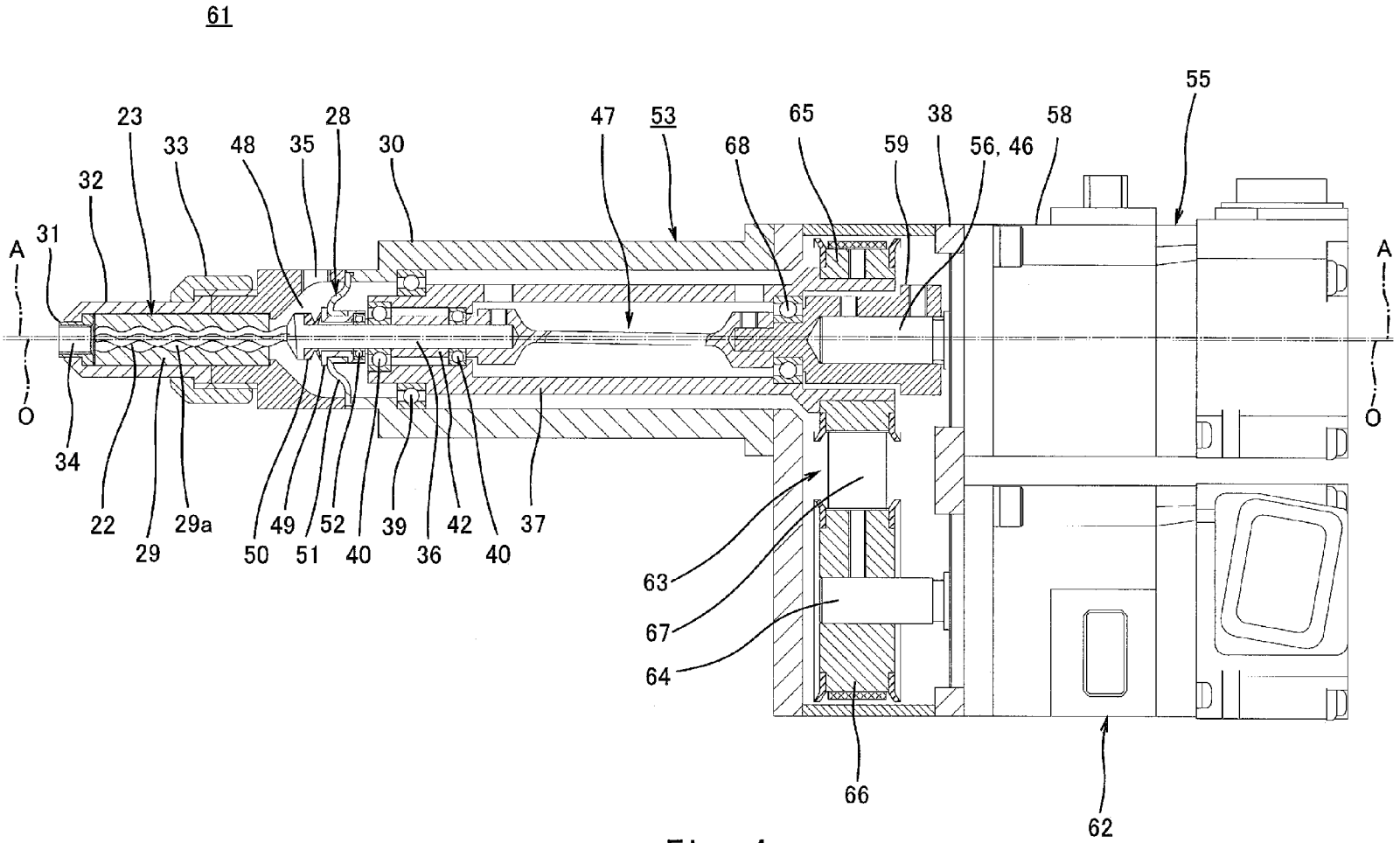
FIG. 4 is a longitudinal sectional view showing Embodiment 3 of the pump apparatus according to the present invention.
Figure 5:
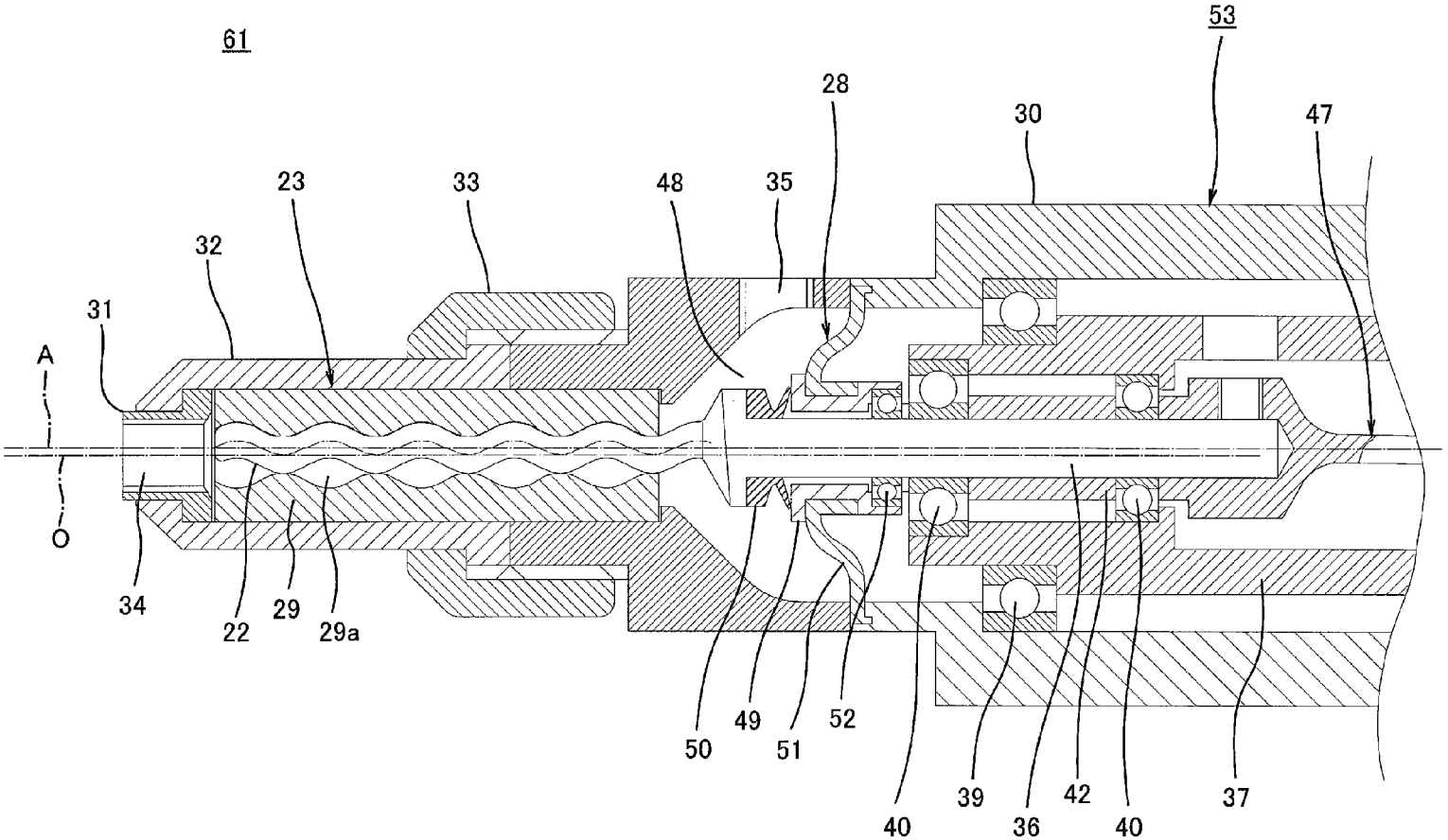
FIG. 5 is an enlarged longitudinal sectional view showing the rotor revolution drive mechanism of the pump apparatus according to Embodiment 3.

Next, the rotor drive mechanism according to Embodiment 3 of the present invention and the pump apparatus including the rotor drive mechanism will be explained in reference to FIGS. 4 and 5. The rotation speed control driving portion 55, the rotor rotation drive mechanism 56, a revolution speed control driving portion 62, and a rotor revolution drive mechanism 63 in a pump apparatus 61 of Embodiment 3 shown in FIG. 4 are respectively different from the rotation speed control driving portion 26, the rotor rotation drive mechanism 27, the revolution speed control driving portion 24, and the rotor revolution drive mechanism 25 in the pump apparatus 21 of Embodiment 1 shown in FIG. 1. Other than these, the pump apparatus 61 of Embodiment 3 is the same as the pump apparatus 21 of Embodiment 1. The same reference numbers are used for the same components, and a repetition of the same explanation is avoided.

As shown in FIG. 4, the rotation speed control driving portion 55 herein is the same as the rotation speed control driving portion 55 of Embodiment 2. The rotation speed control driving portion 55 is an electric speed control motor, such as a servo motor, which is not hollow. The rotation speed control driving portion 55 is attached to the end portion of the intermediate casing 38. The rotating shaft of the reducer 58 included in the rotation speed control driving portion 55 is used as the rotation shaft 46. Therefore, the rotor rotation drive mechanism 56 is the rotation shaft 46. The coupling member 59 is attached to the rotation shaft 46, and the rotation shaft 46 is coupled to a right end portion of the power transmission portion 47 via the coupling member 59.

The revolution speed control driving portion 62 herein is the same as the rotation speed control driving portion 55 of Embodiment 3 shown in FIG. 4. The revolution speed control driving portion 62 is an electric speed control motor, such as a servo motor, which is not hollow. The revolution speed control driving portion 62 is attached to the end portion of the intermediate casing 38 in parallel with the rotation speed control driving portion 55.

Next, the rotor revolution drive mechanism 63 shown in FIG. 4 will be explained. The rotor revolution drive mechanism 63 of Embodiment 3 shown in FIG. 4 is different from the rotor revolution drive mechanism 25 of Embodiment 1 shown in FIG. 1 in that: in the rotor revolution drive mechanism 25 of Embodiment 1 shown in FIG. 1, the rotor portion 24*a* of the revolution speed control driving portion 24 is directly attached to an outer peripheral surface of the eccentric supporting portion 37, and the eccentric supporting portion 37 is directly rotated by the rotation of the rotor portion 24*a*; whereas in the rotor revolution drive mechanism 63 of Embodiment 3 shown in FIG. 4, the eccentric supporting portion 37 is rotated by transferring the rotation of a rotating shaft 64 of the revolution speed control driving portion 62 to the eccentric supporting portion 37 via a pair of first and second timing pulleys (synchronous pulleys) 65 and 66 and a timing belt (synchronous circular belt) 67.

To be specific, as shown in FIG. 4, a right end portion of the eccentric supporting portion 37 is rotatably supported by the coupling member 59 (rotation shaft 46) via a bearing 68, and the first timing pulley 65 is attached to the right end portion of the eccentric supporting portion 37. The second timing pulley 66 is attached to the rotating shaft 64 of the revolution speed control driving portion 62, and the timing belt 67 is hung between the pair of first and second timing pulleys 65 and 66.

In accordance with the pump apparatus 61 of Embodiment 3 shown in FIG. 4, the rotation speed control driving portion 55 is driven to rotate the rotation shaft 46, and the rotation of the rotation shaft 46 is transferred to the rotor 22 via the power transmission portion 47 and the revolution shaft 36. Thus, the rotor 22 rotates. Then, the revolution speed control driving portion 62 is driven to rotate the rotating shaft 64, and the rotation of the rotating shaft 64 is transferred to the eccentric supporting portion 37 via the first and second timing pulleys 65 and 66 and the timing belt 67. Thus, the eccentric supporting portion 37 rotates. By the rotation of the eccentric supporting portion 37, the revolution shaft 36 carries out the revolution movement. Therefore, the revolution shaft 36 can rotate and carry out the revolution movement, i.e., the revolution shaft 36 can carry out the eccentric rotational movement. With this, the rotor 22 carries out the eccentric rotational movement along a desired certain path. Therefore, as with Embodiment 1, the transfer fluid can be suctioned from the second opening 35 (or the first opening 34) and discharged from the first opening 34 (or the second opening 35).

Figure 6:
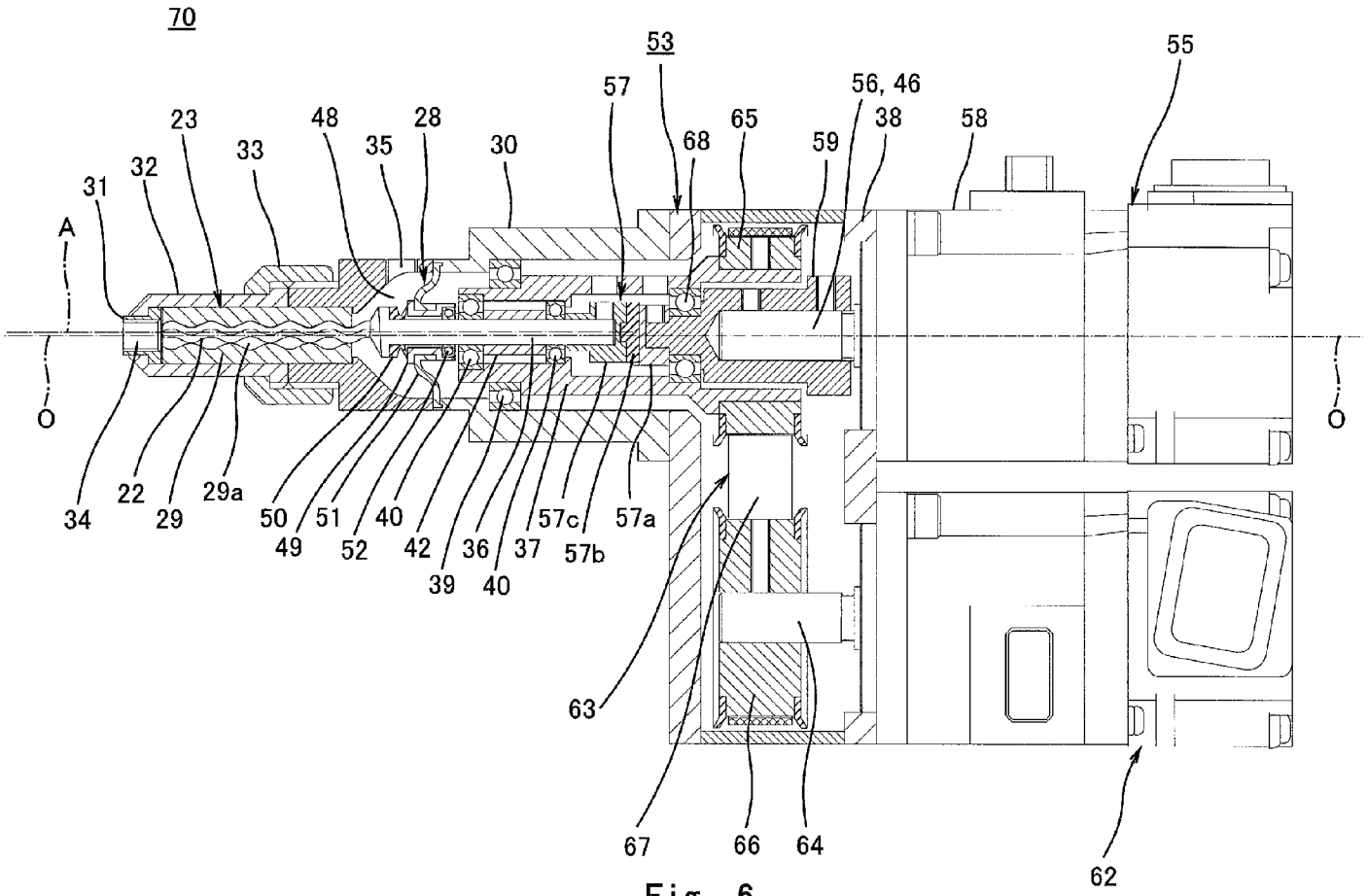
FIG. 6 is a longitudinal sectional view showing Embodiment 4 of the pump apparatus according to the present invention.
Figure 7:
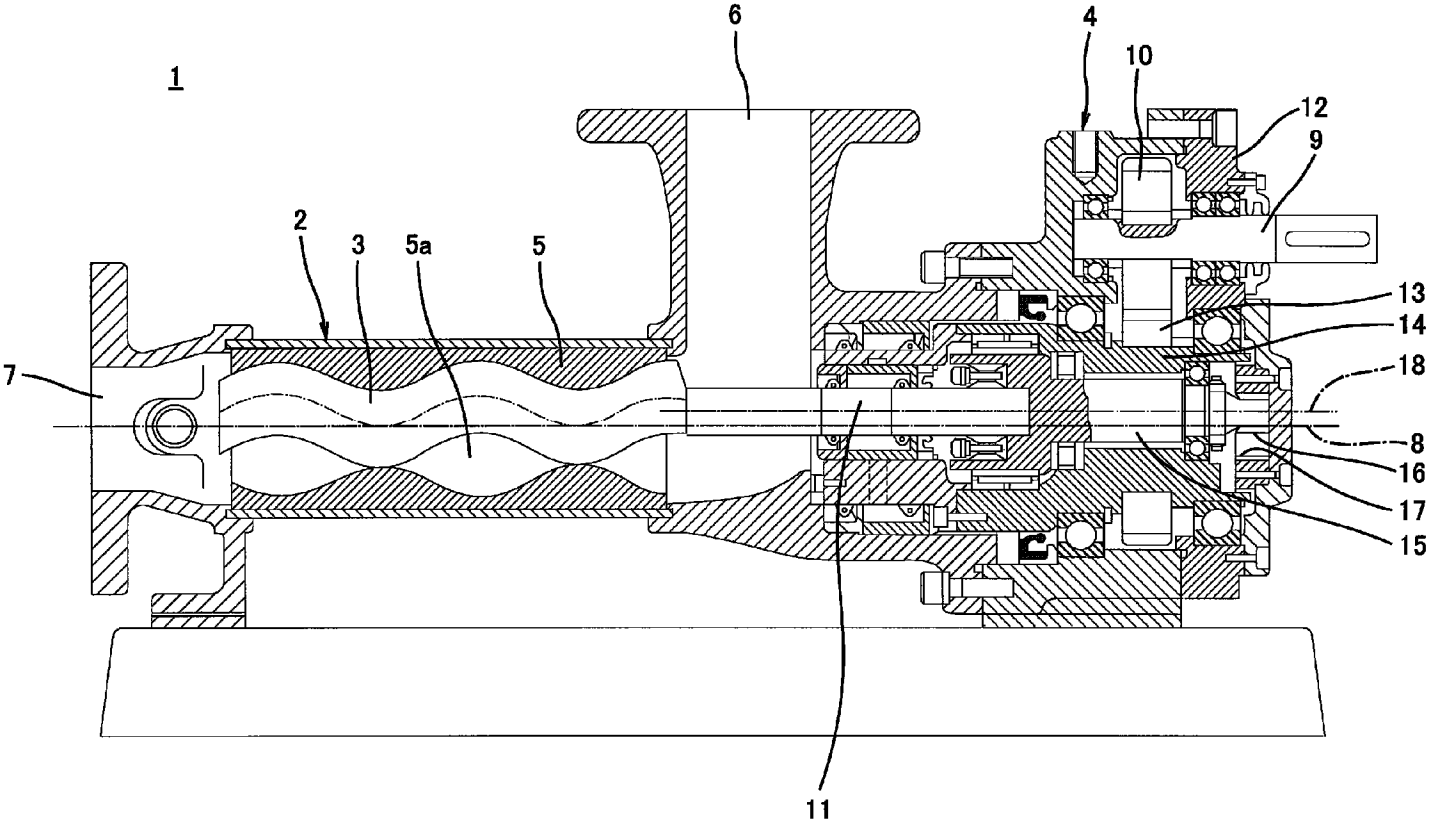
Fig. 7 Prior Art
FIG. 7 is a longitudinal sectional view showing a conventional pump apparatus.

Next, the rotor drive mechanism according to Embodiment 4 of the present invention and the pump apparatus including the rotor drive mechanism will be explained in reference to FIG. 6. The power transmission portion 57 in a pump apparatus 70 of Embodiment 4 shown in FIG. 6 is different from the power transmission portion 47 in the pump apparatus 61 of Embodiment 3 shown in FIG. 4. Other than this, the pump apparatus 70 of Embodiment 4 is the same as the pump apparatus 61 of Embodiment 3. The same reference numbers are used for the same components, and a repetition of the same explanation is avoided.

The power transmission portion 57 included in the pump apparatus 70 of Embodiment 4 shown in FIG. 6 is the Oldham coupling and is the same as the power transmission portion 57 included in the pump apparatus 54 of Embodiment 2 shown in FIG. 3. As shown in FIG. 6, the power transmission portion 57 can transfer the rotation of the rotation shaft 46 to the revolution shaft 36, eccentrically provided with respect to the rotation shaft 46, to rotate the revolution shaft 36. The power transmission portion 57 that is the Oldham coupling includes the driving portion 57*a*, the intermediate portion 57*b*, and the driven portion 57*c*. The driving portion 57*a* is coupled to the rotation shaft 46 via the coupling member 59. The driven portion 57*c* is coupled to the revolution shaft 36, and the intermediate portion 57*b* couples the driving portion 57*a* with the intermediate portion 57*b*.

As with Embodiment 1, in accordance with the pump apparatus 70 of Embodiment 4 shown in FIG. 6, by driving the rotation speed control driving portion 55 and the revolution speed control driving portion 62 in, for example, the normal direction (or the reverse direction), the transfer fluid can be suctioned from the second opening 35 (or the first opening 34) and discharged from the first opening 34 (or the second opening 35).

Each of the pump apparatuses 21, 54, 61, and 70 of Embodiments 1 to 4 can cause the rotor 22 to rotate and carry out the revolution movement with the outer peripheral surface of the rotor 22 shown in FIGS. 1 to 6 and the inner peripheral surface of the stator inner hole 29*a* shown in FIGS. 1 to 6 not contacting each other or contacting each other by a predetermined intensity. In a case where the rotor 22 is caused to carry out the eccentric rotational movement with the outer peripheral surface of the rotor 22 and the inner peripheral surface of the stator inner hole 29*a* contacting each other by a predetermined intensity, the rotor 22 may be caused to rotate and carry out the revolution movement with the rotor 22 and one of parallel inner surfaces of the stator inner hole 29*a* contacting each other by a predetermined appropriate intensity and with the rotor 22 and the other one of parallel inner surfaces of the stator inner hole 29*a* not contacting each other. Even with this, the pump apparatus can transfer and fill the fluid with high flow rate accuracy, low pulsation, and a long operating life.

Moreover, each of the pump apparatuses 21, 54, 61, and 70 of Embodiments 1 to 4 causes the rotor 22 to carry out the eccentric rotational movement at a constant speed to transfer the fluid with low pulsation. Instead of this, by periodically changing the speed of an eccentric rotation of the rotor 22, the transfer fluid can be transferred with pulsation of desired cycle and intensity.

Further, in the pump apparatus 21, 54, 61, and 70 of Embodiments 1 to 4, the stator 29 is formed by engineering plastic, such as Teflon (trademark). However, the stator 29 may be formed by synthetic rubber, a metal, or the like. The rotor 22 may be formed by engineering plastic, such as Teflon (trademark).

INDUSTRIAL APPLICABILITY

As above, each of the rotor drive mechanism and the pump apparatus according to the present invention has an excellent effect of being able to use the rotor rotating at high speed by reducing the amount of heat and vibrations generated when the rotor is rotated at high speed and by lowering the contact pressure between the outer surface of the rotor and the inner surface of the stator inner hole or preventing the outer surface of the rotor and the inner surface of the stator inner hole from contacting each other. The present invention is suitably applicable to such rotor drive mechanism and pump apparatus.

The invention claimed is:

1. A rotor drive mechanism capable of causing an external screw type rotor of a uniaxial eccentric screw pump to rotate and carry out a revolution movement, the uniaxial eccentric screw pump being configured such that the external screw type rotor is attached to an inner hole of an internal screw type stator; and causing the external screw type rotor to be driven by a rotation speed control driving portion such that the external screw type rotor rotates and to be driven by a revolution speed control driving portion such that the external screw type rotor carries out the revolution movement, the rotor drive mechanism comprising:

a rotation shaft configured to have a central axis at a certain position and be rotatably supported; and a revolution shaft configured to be supported so as to be able to revolve about a certain central position and rotate and to have one end portion coupled to the rotation shaft via a power transmission portion and the other end portion coupled to the external screw type rotor; wherein the rotation shaft is rotated by the rotation speed control driving portion, and the revolution shaft is revolved by the revolution speed control driving portion to carry out an eccentric rotational movement, the rotor drive mechanism further comprising a shaft sealing structure configured such that a gap between an outer peripheral portion of said other end portion of the revolution shaft which end portion is located on an external screw type rotor side and an inner peripheral portion of a casing in the pump is sealed, wherein:

the shaft sealing structure includes a circular coupling portion having an insert hole through which the revolution shaft is rotatably inserted, a gap between an inner peripheral portion of the circular coupling portion and an outer peripheral portion of the revolution shaft is sealed by a sealing portion, and a gap between an outer peripheral portion of the circular coupling portion and the inner peripheral portion of the casing is sealed by a diaphragm; and the circular coupling portion is rotatably attached to the revolution shaft via a bearing.

2. The rotor drive mechanism according to claim 1, further comprising an eccentric supporting portion rotatably provided on a casing to be rotated by the revolution speed control driving portion, wherein the revolution shaft is rotatably provided in the eccentric supporting portion so as to be eccentrically located with respect to a central axis of the eccentric supporting portion.

3. The rotor drive mechanism according to claim 1, wherein the power transmission portion is a flexible joint or an Oldham coupling.

4. The rotor drive mechanism according to claim 1, wherein each of the rotation speed control driving portion and the revolution speed control driving portion is an electric servo motor.

5. The rotor drive mechanism according to claim 1, wherein the sealing portion slidably contacts an outer peripheral surface of said other end portion of the revolution shaft and slidably contacts an end surface of the circular coupling portion.

6. A pump apparatus comprising:

a rotor drive mechanism; and a uniaxial eccentric screw pump configured to be rotated by the rotor drive mechanism;

wherein the rotor drive mechanism is capable of causing an external screw type rotor of the uniaxial eccentric screw pump to rotate and carry out a revolution movement, the uniaxial eccentric screw pump being configured such that the external screw type rotor is attached to an inner hole of an internal screw type stator, and causing the external screw type rotor to be driven by a rotation speed control driving portion such that the external type rotor rotates, and to be driven by a revolution speed control driving portion such that the external screw type rotor carries out the revolution movement; and wherein the rotor drive mechanism comprises:

a rotation shaft configured to have a central axis at a certain position and be rotatably supported; and a revolution shaft configured to: be supported so as to be able to revolve about a certain central position and rotate; and have one end portion coupled to the rotation shaft via a power transmission portion and the other end portion coupled to the external screw type rotor; wherein the rotation shaft is rotated by the rotation speed control driving portion, and the revolution shaft is revolved by the revolution speed control driving portion to carry out an eccentric rotational movement, the rotor drive mechanism further comprising a shaft sealing structure configured such that a gap between an outer peripheral portion of said other end portion of the revolution shaft which end portion is located on an external screw type rotor side and an inner peripheral portion of an casing in the pump is sealed, wherein:

the shaft sealing structure includes a circular coupling portion having an insert hole through which the revolution shaft is rotatably inserted, a gap between an inner peripheral portion of the circular coupling portion and an outer peripheral portion of the revolution shaft is sealed by a sealing portion, and a gap between an outer peripheral portion of the circular coupling portion and the inner peripheral portion of the casing is sealed by a diaphragm; and the circular coupling portion is rotatably attached to the revolution shaft via a bearing.

7. The pump apparatus according to claim 6, wherein the rotor drive mechanism rotates the external screw type rotor with the external screw type rotor not contacting an inner surface of the inner hole of the internal screw type stator.

* * * * *

UNITED STATES PATENT AND TRADEMARK OFFICE

CERTIFICATE OF CORRECTION

PATENT NO. : 8,622,689 B2
APPLICATION NO. : 12/674149
DATED : January 7, 2014
INVENTOR(S) : Teruaki Akamatsu et al.

It is certified that error appears in the above-identified patent and that said Letters Patent is hereby corrected as shown below:

In the Specification

Column 3, line 29, delete “claim 1” and;

Column 3, line 53, delete “claim 2”.

Signed and Sealed this
Fifteenth Day of July, 2014

Michelle K. Lee

Michelle K. Lee
*Deputy Director of the United States Patent and Trademark Office*